US006809474B2

(12) United States Patent
Shirakawa

(10) Patent No.: US 6,809,474 B2
(45) Date of Patent: Oct. 26, 2004

(54) THIN-FILM EL DEVICE, AND ITS FABRICATION PROCESS

(75) Inventor: Yukihiko Shirakawa, Chuo-ku (JP)

(73) Assignee: TDK Corporation, Tokyo (JP)

( * ) Notice: Subject to any disclaimer, the term of this patent is extended or adjusted under 35 U.S.C. 154(b) by 189 days.

(21) Appl. No.: 09/866,732

(22) Filed: May 30, 2001

(65) Prior Publication Data

US 2002/0041147 A1 Apr. 11, 2002

(30) Foreign Application Priority Data

Sep. 29, 2000 (JP) ..... 2000-299352

(51) Int. Cl.[7] ..... H01J 1/62

(52) U.S. Cl. ..... 313/509; 313/506; 313/498; 445/25; 445/24; 427/66

(58) Field of Search ..... 313/506, 509, 313/498; 445/25, 24; 427/66

(56) References Cited

U.S. PATENT DOCUMENTS

| | | | | | |
|---|---|---|---|---|---|
| 3,919,577 | A | * | 11/1975 | Hoehn et al. | 313/587 |
| 4,188,565 | A | * | 2/1980 | Mizukami et al. | 313/509 |
| 4,547,703 | A | * | 10/1985 | Fujita et al. | 313/509 |
| 4,672,266 | A | * | 6/1987 | Taniguchi et al. | 313/509 |
| 4,862,033 | A | * | 8/1989 | Migita et al. | 313/502 |
| 5,432,015 | A | * | 7/1995 | Wu et al. | 428/690 |
| 5,679,472 | A | * | 10/1997 | Wu et al. | 428/690 |
| 5,736,754 | A | * | 4/1998 | Shi et al. | 257/89 |
| 5,786,664 | A | * | 7/1998 | Liu | 313/506 |
| 5,847,506 | A | * | 12/1998 | Nakayama et al. | 313/504 |
| 5,856,029 | A | | 1/1999 | Burrows | |
| 5,863,679 | A | * | 1/1999 | Tsushima et al. | 430/14 |
| 6,107,735 | A | * | 8/2000 | Hora | 313/506 |
| 6,124,024 | A | * | 9/2000 | Hosokawa et al. | 428/212 |
| 6,242,858 | B1 | * | 6/2001 | Sun | 313/503 |
| 6,514,891 | B1 | * | 2/2003 | Lee | 501/32 |
| 6,577,059 | B2 | * | 6/2003 | Shirakawa et al. | 313/506 |
| 2002/0130616 | A1 | * | 9/2002 | Shirakawa et al. | 313/509 |

FOREIGN PATENT DOCUMENTS

| | | |
|---|---|---|
| DE | 40 19 988 | 1/1991 |
| EP | 0 555 470 | 8/1993 |
| JP | 56-52438 | 12/1981 |
| JP | 3-187186 | 8/1991 |
| JP | 7-50197 | 2/1995 |
| JP | 7-44072 | 5/1995 |

OTHER PUBLICATIONS

S. Tanaka, Monthly Magazine Display, pps. 1–10, "Recent Development of Inorganic and Organic EL Display," Apr. 1998.

X. Wu, International Display Workshop (IDW), pps. 593–596, "Multicolor Thin–Flim Ceramic Hybrid EL Displays," 1997.

* cited by examiner

*Primary Examiner*—Ashok Patel
*Assistant Examiner*—Holly Harper
(74) *Attorney, Agent, or Firm*—Oblon, Spivak, McClelland, Maier & Neustadt, P.C.

(57) ABSTRACT

The invention has for its object to provide, without incurring any cost increase, a thin-film EL device in which a dielectric layer is corrected for non-flat portions to have a smooth surface, thereby ensuring enhanced display quality, and its fabrication process. This object is achieved by the provision of a thin-film EL device having at least a structure comprising an electrically insulating substrate (11), a lower electrode layer (12) stacked on the substrate according to a given pattern, a multilayer dielectric layer (13) formed thereon by repeating a solution coating-and-firing step plural times, and a light-emitting layer (14), a thin-film insulator layer (15) and a transparent electrode layer (16) stacked on the dielectric layer. The multilayer dielectric layer has a thickness of at least four times as large as a thickness of the electrode layer and 4 μm to 16 μm inclusive. The fabrication process is also provided.

17 Claims, 8 Drawing Sheets

THIN-FILM EL DEVICE, AND ITS FABRICATION PROCESS

BACKGROUND OF THE INVENTION

1. Art Field

This invention relates to a thin-film EL device having at least a structure comprising an electrically insulating substrate, a patterned electrode layer stacked on the substrate, and a dielectric layer, a light-emitting layer and a transparent electrode layer stacked on the electrode layer.

2. Background Art

EL devices are now practically used in the form of backlights for liquid crystal displays (LCDs) and watches. An EL device works on a phenomenon in which a substance emits light at an applied electric field, viz., an electroluminescence (EL) phenomenon. The EL device is broken down into two types, one referred to as a dispersion type EL device having a structure wherein electrode layers are provided on the upper and lower sides of a dispersion with light-emitting powders dispersed in an organic material or porcelain enamel, and another as a thin-film EL device using a thin-film light-emitting substance provided on an electrically insulating substrate and interposed between two electrode layers and two thin-film insulators. These types of EL devices are each driven in a direct or alternating voltage drive mode. Known for long, the dispersion type EL device has the advantage of ease of fabrication; however, it has only limited use thanks to low luminance and short service life. On the other hand, the thin-film EL device has recently wide applications due to the advantages of high luminance and very long-lasting quality.

The structure of a typical double-insulation type thin-film EL device out of conventional thin-film EL devices is shown in FIG. 2. In this thin-film EL device, a transparent substrate 21 formed of a green glass sheet used for liquid crystal displays or PDPs is stacked thereon with a transparent electrode layer 22 comprising an ITO of about 0.2 $\mu$m to 1 $\mu$m in thickness and having a given striped pattern, a first insulator layer 23 in a transparent thin-film form, a light-emitting layer 24 of about 0.2 $\mu$m to 1 $\mu$m in thickness and a second insulator layer 25 in a transparent thin-film form. Further, an electrode layer 26 formed of, e.g., an Al thin-film patterned in a striped manner is provided in such a way as to be orthogonal with respect to the transparent electrode layer 22. In a matrix defined by the transparent electrode layer 22 and the electrode layer 26, voltage is selectively applied to a selected given light-emitting substance to allow a light-emitting substance of a specific pixel to emit light. The resultant light is extracted from the substrate side. Having a function of limiting currents flowing through the light-emitting layer, such thin-film insulator layers make it possible to inhibit the dielectric breakdown of the thin-film EL device, and so contribute to the achievement of stable light-emitting properties. Thus, the thin-film EL device of this structure has now wide commercial applications.

For the aforesaid thin-film transparent insulator layers 23 and 25, transparent dielectric thin films of $Y_2O_3$, $Ta_2O_5$, $Al_3N_4$, $BaTiO_3$, etc. are formed at a thickness of about 0.1 to 1 $\mu$m by means of sputtering, evaporation or the like.

For light-emitting materials, ZnS with yellowish orange light-emitting Mn added thereto has mainly been used due to ease of film formation and in consideration of light-emitting properties. For color display fabrication, the use of light-emitting materials capable of emitting light in the three primary colors, red, green and blue is inevitable. These materials known so far in the art, for instance, include SrS with blue light-emitting Ce added thereto, ZnS with blue light-emitting Tm added thereto, ZnS with red light-emitting Sm added thereto, CaS with red light-emitting Eu added thereto, ZnS with green light-emitting Tb added thereto, and CaS with green light-emitting Ce added thereto.

In an article entitled "The Latest Development in Displays" in "Monthly Display", April, 1998, pp. 1–10, Shosaku Tanaka shows ZnS, Mn/CdSSe, etc. for red light-emitting materials, ZnS:TbOF, ZnS:Tb, etc. for green light-emitting materials, and SrS:Cr, $(SrS:Ce/ZnS)_n$, $Ca_2Ga_2S_4$:Ce, $Sr_2Ga_2S_4$:Ce, etc. for blue light-emitting materials as well as SrS:Ce/ZnS:Mn, etc. for white light-emitting materials.

IDW (International Display Workshop), '97 X. Wu "Multicolor Thin-Film Ceramic Hybrid EL Displays", pp. 593–596 shows that SrS:Ce out of the aforesaid materials is used for a thin-film EL device having a blue light-emitting layer. In addition, this publication shows that when a light-emitting layer of SrS:Ce is formed by an electron beam evaporation process in a $H_2S$ atmosphere, it is possible to obtain a light-emitting layer of high purity.

However, a structural problem with such a thin-film EL device remains unsolved. The problem is that since the insulator layers are each formed of a thin film, it is difficult to reduce to nil steps at the edges of the pattern of the transparent electrode, which occur when a large area display is fabricated, and defects in the thin-film insulators, which are caused by dust, etc. occurring in the process of display production, resulting in a destruction of the light-emitting layer due to a local dielectric strength drop. Such defects offer a fatal problem to display devices, and produce a bottleneck in the wide practical use of thin-film EL devices in a large-area display system, in contrast to liquid crystal displays or plasma displays.

To provide a solution to the defect problem with such thin-film insulators, JP-A 07-50197 and JP-B 07-44072 disclose a thin-film EL device using an electrically insulating ceramic substrate as a substrate and a thick-film dielectric material for the thin-film insulator located beneath the light-emitting substance. As shown in FIG. 3, this thin-film EL device has a structure wherein a substrate 31 such as a ceramic substrate is stacked thereon with a lower thick-film electrode layer 32, a thick-film dielectric layer 33, a light-emitting layer 34, a thin-film insulator layer 35 and an upper transparent electrode 36. Unlike the thin-film EL device shown in FIG. 2, the transparent electrode layer is formed on the uppermost position of the device because the light emitted from the light-emitting substance is extracted out of the upper side of the device facing away from the substrate.

The thick-film dielectric layer in this thin-film EL device has a thickness of a few tens of $\mu$m to a few hundred $\mu$m or is several hundred to several thousand times as thick as the thin-film insulator layer. Thus, the thin-film EL device has the advantages of high reliability and high fabrication yields because of little or no dielectric breakdown caused by pinholes formed by steps at electrode edges or dust, etc. occurring in the device fabrication process. The use of this thick-film dielectric layer leads to another problem that the effective voltage applied to the light-emitting layer drops. However, this problem can be solved or eliminated by using a high dielectric constant material for the dielectric layer.

However, the light-emitting layer stacked on the thick-film dielectric layer has a thickness of barely a few hundred nm that is about 1/100 of that of the thick-film dielectric layer. For this reason, the thick-film dielectric layer must have a smooth surface at a level less than the thickness of the light-emitting layer. However, it is still difficult to sufficiently smooth down the surface of a dielectric layer fabricated by an ordinary thick-film process.

To be more specific, a thick-film dielectric layer, because of being essentially constructed of ceramics using a powdery material, usually suffers from a volume shrinkage of about 30 to 40% upon closely sintered. However, ordinary ceramics are closely packed through a three-dimensional shrinkage upon sintering whereas a thick-film ceramic material formed on a substrate does not shrink across the substrate because the thick film is constrained to the substrate; its volume shrinkage occurs in the thickness direction or one-dimensionally alone. For this reason, the sintering of the thick-film dielectric layer does not proceed to a sufficient level, yielding an essentially porous layer.

Since the process of close packing proceeds through a ceramic solid phase reaction of powders having a certain particle size distribution, sintering abnormalities such as abnormal crystal grain growth and macropores are likely to occur. In addition, the surface roughness of the thick film is absolutely greater than the crystal grain size of polycrystal sintered grains and, accordingly, the thick film has surface asperities of at least sub-$\mu$m size even though it is free from such defects as mentioned above.

When the dielectric layer has surface defects or a porous structure or asperity shape as mentioned above, it is impossible to deposit thereon a light-emitting layer formed by evaporation, sputtering or the like uniformly following the surface shape thereof. This makes it impossible to effectively apply an electric field to the portion of the light-emitting layer formed on a non-flat portion of the substrate, resulting in problems such as a decrease in the effective light-emitting area, and a light emission luminance decrease due to a local dielectric breakdown of the light-emitting layer, which is caused by local non-uniform thicknesses. Furthermore, locally large thickness fluctuations cause the strength of an electric field applied to the light-emitting layer to vary too locally largely to obtain any definite light emission voltage threshold.

Thus, operations for polishing down large surface asperities of a thick-film dielectric layer and then removing much finer asperities by a sol-gel step are needed for conventional fabrication processes.

However, the polishing of a large-area substrate for display or other purposes is technically difficult to achieve, and is a factor for cost increases as well. The addition of the sol-gel step is another factor for cost increases. When a thick-film dielectric layer has abnormal sintered spots which may give rise to asperities too large for removal by polishing, yields drop because they cannot be removed even by the addition of the sol-gel step. It is thus very difficult to use a thick-film dielectric material to form a light emission defect-free dielectric layer at low cost.

A thick-film dielectric layer is formed by a ceramic powder material sintering process where elevated firing temperature is needed. As is the case with ordinary ceramics, a firing temperature of at least 800° C. and usually 850° C. is needed. To obtain a closely packed thick-film sintered body in particular, a firing temperature of at least 900° C. is needed. In consideration of heat resistance and a reactivity problem with respect to the dielectric layer, the substrate used for the formation of such a thick-film dielectric layer is limited to alumina or zirconia ceramic substrate; it is difficult to rely on inexpensive glass substrates. The requisite for the aforesaid ceramic substrate to be used for display purposes is that it has a large area and satisfactory smoothness. The substrate meeting such conditions is obtained only with much technical difficulty, and is yet another factor for cost increases.

For the metal film used as the lower electrode layer, it is required to use costly noble metals such as palladium and platinum in view of its heat resistance. This, too, is a factor for cost increases.

SUMMARY OF THE INVENTION

An object of the invention is to provide a solution to all problems with conventional thin-film EL devices, viz., (1) an fatal defect to display devices, which, when an insulator layer is made up of a thin film, results from destruction of a light-emitting layer due to a local dielectric strength decrease ascribable to defects in the insulator layer, (2) poor light emission properties which, when a thick-film dielectric layer made up of ceramics is used, result from defects on the surface of the dielectric layer, the fact that the dielectric layer is porous, and the asperity configuration of the surface of the dielectric layer, (3) cost increases due to the addition of a difficult-to-perform step, i.e., the step of polishing the surface of the thick-film dielectric layer, and further cost increases due to the addition of a sol-gel step, and (4) limitations imposed on the selection of substrate and electrode layer materials thanks to the firing temperature for the thick-film dielectric layer.

Another object of the invention is to provide a thin-film EL device and its fabrication process without incurring any cost increase. The thin-film EL device of the invention allows restrictions on the selection of substrate materials to be removed, and so makes it possible to use glass substrates which are inexpensive and can be easily processed to a large area, and can rely on a quick-and-easy process to make correction for non-flat portions of a dielectric layer due to an electrode layer, and dust, etc. resulting from process steps, thereby preventing any dielectric strength decrease. In addition, the thin-film EL device of the invention ensures high display quality by virtue of the satisfactory flatness of the surface of the dielectric layer.

The aforesaid object is achievable by the following embodiments (1) to (5) of the invention.

(1) A thin-film EL device having at least a structure comprising an electrically insulating substrate, a patterned electrode layer stacked on said substrate, and a dielectric layer, a light-emitting layer and a transparent electrode stacked on said electrode layer, wherein:

said dielectric layer is a multilayer dielectric layer formed in a multilayer form by repeating a solution coating-and-firing step plural times, and said multilayer dielectric layer has a thickness of at least four times as large as a thickness of said electrode layer and 4 $\mu$m to 16 $\mu$m inclusive.

(2) The thin-film EL device according to (1) above, wherein said multilayer dielectric layer is formed by repeating said solution coating-and-firing step at least three times.

(3) The thin-film EL device according to (1) above, wherein said multilayer dielectric layer has a thickness per sub-layer of at least ½ of said electrode layer.

(4) A process of fabricating a thin-film EL device having at least a structure comprising an electrically insulating substrate, a patterned electrode layer stacked on said substrate, and a dielectric layer, a light-emitting layer and a transparent electrode stacked on said electrode layer, wherein:

said dielectric layer is provided on said electrode layer in a multilayer form by repeating coating-and-firing of a dielectric precursor solution plural times.

(5) The process of fabricating a thin-film EL device according to (4) above, wherein the coating-and-firing of said dielectric precursor solution is repeated at least three times.

EXPLANATION OF THE PREFERRED EMBODIMENTS

In the thin-film EL device of the invention, an electrode layer having a pattern is formed on an electrically insulating substrate. On the electrode layer, a multilayer dielectric layer is formed by repeating a solution coating-and-firing step plural times, followed by the stacking of a light-emitting layer and a transparent electrode layer thereon. The multilayer dielectric layer has a thickness of at least four times as large as that of the electrode layer and 4 $\mu$m to 16 $\mu$m inclusive.

Figure 1:
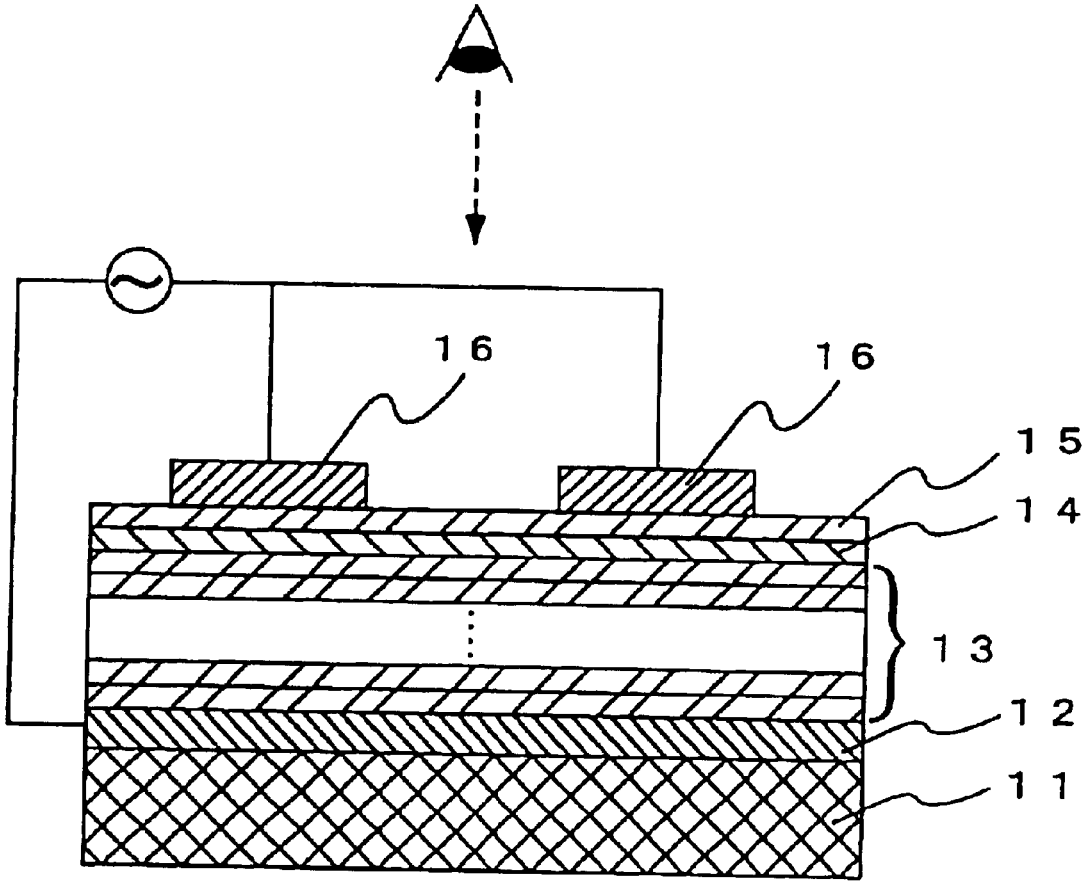
FIG. 1 is a sectional view illustrative of the structure of the thin-film EL device according to the invention.
Figure 2:
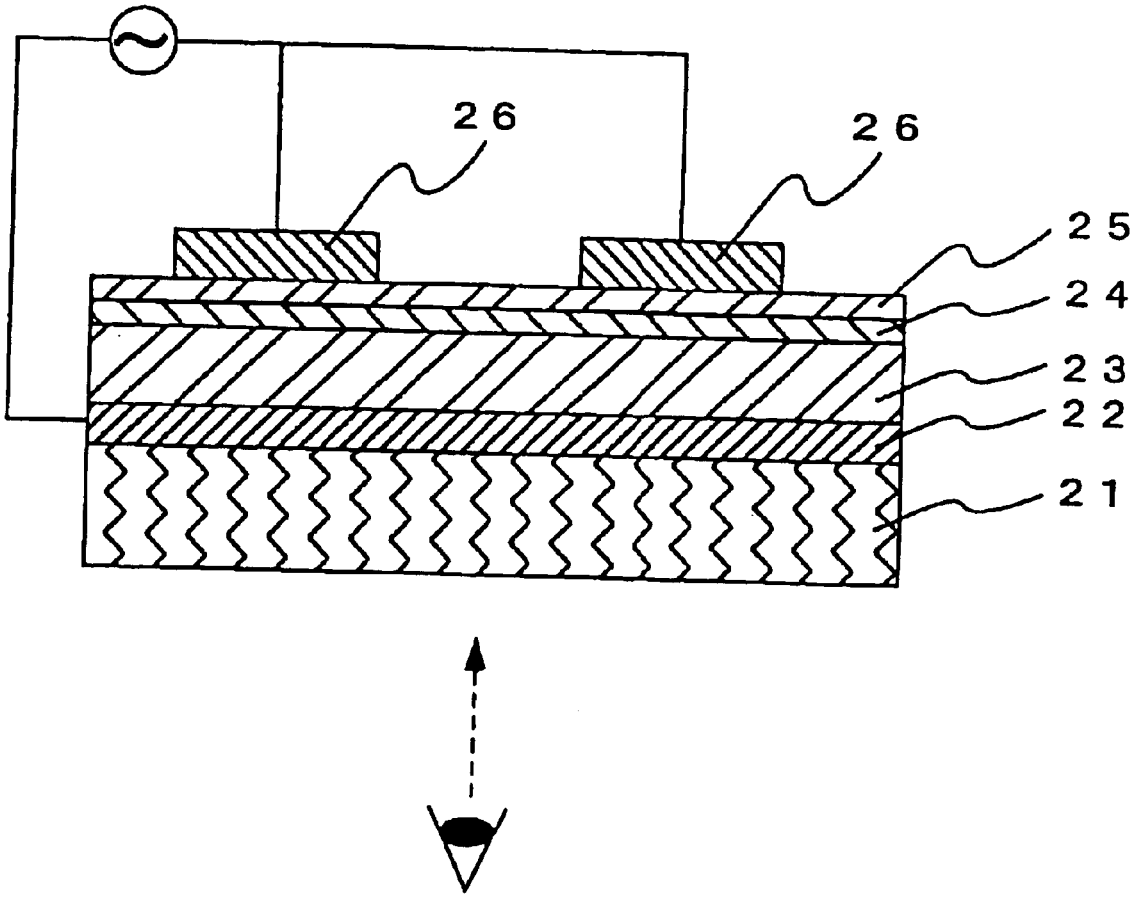
FIG. 2 is a sectional view illustrative of the structure of one conventional thin-film EL device.
Figure 3:
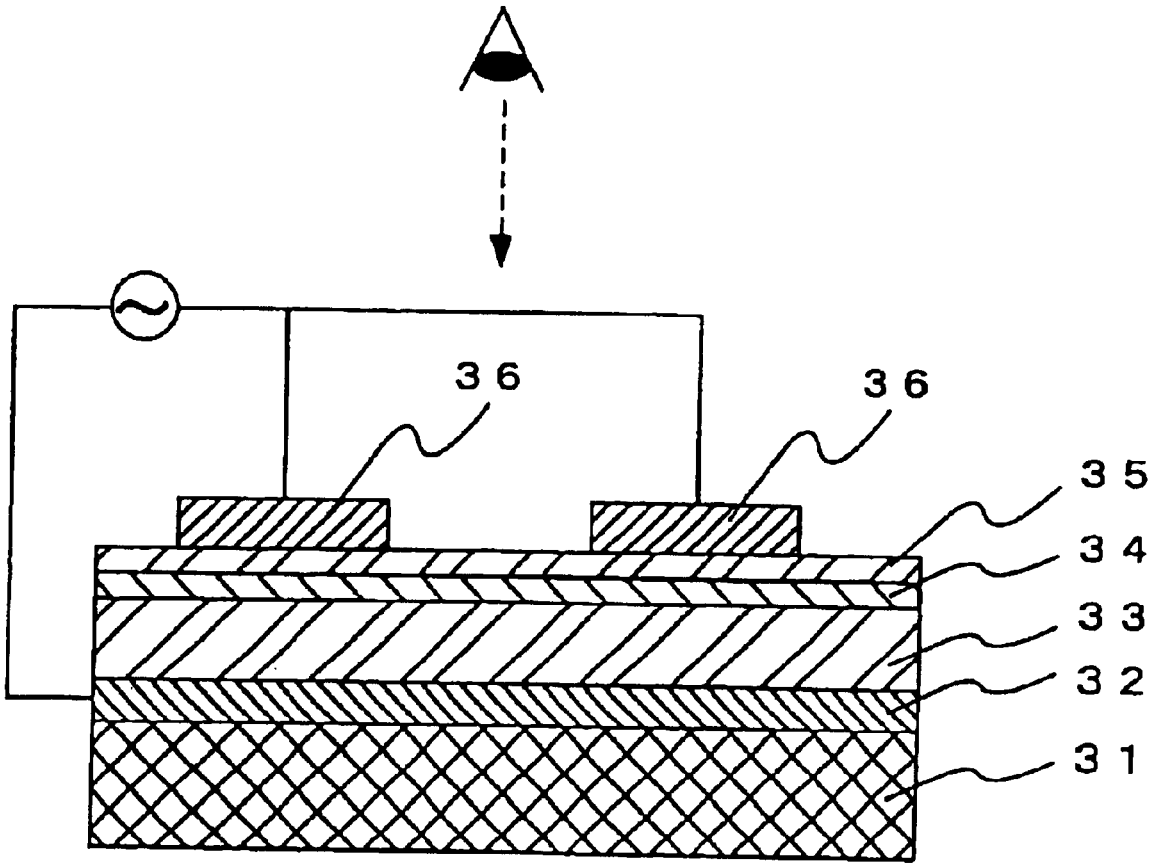
FIG. 3 is a sectional view illustrative of the structure of another conventional thin-film EL device.

FIG. 1 is illustrative of the structure of the thin-film EL device according to the invention. The thin-film EL device of the invention has a structure wherein a lower electrode layer 12 having a given pattern is stacked on an electrically insulating substrate 11, and a multilayer dielectric layer 13 formed by repeating a solution coating-and-firing step plural times is stacked on the lower electrode layer 12, followed by the stacking of a light-emitting layer 14, a thin-film insulator layer 15 and a transparent electrode layer 16 on the multilayer dielectric layer 13. In this connection, the insulator layer 15 may be dispensed with. The lower electrode layer and upper transparent electrode layer are each configured in a striped fashion, and are located in mutually orthogonal directions. The lower electrode layer and upper transparent electrode layers are respectively selected and voltage is selectively applied to the light-emitting layer at sites where both electrodes cross at right angles, whereby specific pixels are allowed to emit light.

For the substrate, any desired material may be used provided that it has electrical insulating properties and maintains given heat-resistant strength without contaminating the lower electrode layer and dielectric layer.

Exemplary substrates are ceramic substrates such as alumina ($Al_2O_3$), quartz glass ($SiO_2$), magnesia (MgO), forsterite ($2MgO.SiO_2$), steatite ($MgO.SiO_2$), mullite ($3Al_2O_3.2SiO_2$), beryllia (BeO), zirconia ($ZrO_2$), aluminum-nitride (AlN), silicon nitride (SiN) and silicon carbide (SiC) substrates, and glass substrates such as crystallized glass, high heat-resistance glass and green sheet glass substrates. Enameled metal substrates, too, may be used.

Of these substrates, particular preference is given to crystallized glass and high heat-resistance glass substrates as well as green sheet glass substrates on condition that they are compatible with the firing temperature for the dielectric layer to be formed due to their low cost, surface properties, flatness and ease of large-area substrate fabrication.

The lower electrode layer is configured in such a way as to have a pattern comprising a plurality of stripes. It is then desired that the line width define the width of one pixel and the space between lines define a non-light emission area, and so the space between lines be reduced as much as possible. Although depending on the end display resolution, for instance, a line width of 200 to 500 $\mu$m and a space of about 20 $\mu$m are needed.

The lower electrode layer should preferably be formed of a material which ensures high electrical conductivity, receives no damage during dielectric layer formation, and has a low reactivity with respect to the dielectric layer or light-emitting layer. Desired for such a lower electrode layer material are noble metals such as Au, Pt, Pd, Ir and Ag, noble metal alloys such as Au-Pd, Au-Pt, Ag-Pd, and Ag-Pt, and electrode materials composed mainly of noble metals such as Ag-Pd-Cu with base metal elements added thereto, because oxidation resistance with respect to an oxidizing atmosphere used for the firing of the dielectric layer material can be easily obtained. Use may also be made of oxide conductive materials such as ITO, $SnO_2$ (Nesa film) and ZnO-Al or, alternatively, base metals such as Ni and Cu provided that the firing of the dielectric layer must be carried out at a partial pressure of oxygen at which these base metals are not oxidized. The lower electrode layer may be formed by known techniques such as sputtering, evaporation, and plating processes.

The dielectric layer should preferably be constructed of a material having a high dielectric constant and high dielectric strength. Here let e1 and e2 stand for the dielectric constants of the dielectric layer and light-emitting layer, respectively, and d1 and d2 represent the thicknesses thereof. When voltage Vo is applied between the upper electrode layer and the lower electrode layer, voltage V2 is then given by $$V2/Vo=(e1\times d2)/(e1\times d2+e2\times d1) \quad (1)$$

Here the specific dielectric constant and thickness of the light-emitting layer are assumed to be e2=10 and d2=1 $\mu$m. Then, $$V2/Vo=e1/(e1+10\times d1) \quad (2)$$

The voltage effectively applied to the light-emitting layer should be at least 50%, preferably at least 80%, and more preferably at least 90% of the applied voltage. From the aforesaid expressions, it is thus found that:

$$\text{for at least 50\%, } e1\leqq 10\times d1 \quad (3)$$

$$\text{for at least 80\%, } e1\leqq 40\times d1 \quad (4)$$

$$\text{for at least 90\%, } e1\leqq 90\times d1 \quad (5)$$

In other words, the specific dielectric constant of the dielectric layer should be at least 10 times, preferably at least 40 times, and more preferably at least 90 times as large as the thickness of the dielectric layer as expressed in $\mu$m. For instance, if the thickness of the dielectric layer is 5 $\mu$m, the specific dielectric constant thereof should be at least 50, preferably at least 200, and more preferably at least 450.

For such a high dielectric constant material, for instance, use may be made of (ferroelectric) dielectric materials having perovskite structures such as $BaTiO_3$, $(Ba_xCa_{1-x})TiO_3$, $(Ba_xSr_{1-x})TiO_3$, $PbTiO_3$ and $Pb(Zr_xTi_{1-x})O_3$, composite perovskite-relaxor ferroelectric materials represented by $Pb(Mg_{1/3}Ni_{2/3})O_3$ or the like, bismuth layer-structured compounds represented by $Bi_4Ti_3O_{12}$, $SrBi_2Ta_2O_9$ or the like, and tungsten bronze ferroelectric materials represented by $(Sr_xBa_{1-x})Nb_2O_6$, $PbNbO_6$ or the like. Among others, preference is given to ferroelectric materials having perovskite structures such as $BaTiO_3$ and PZT, because they have a relatively high dielectric constant and are easily synthesized at relatively low temperatures.

The aforesaid dielectric layer is formed by solution coating-and-firing processes such a sol-gel process and an MOD process. Generally, the sol-gel process refers to a film formation process wherein a given amount of water is added to a metal alkoxide dissolved in a solvent for hydrolysis and a polycondensation reaction, and the resultant precursor solution of a sol having an M—O—M bond is coated and fired on a substrate, and the MOD (metallo-organic decomposition) process refers to a film formation process wherein a metal salt of carboxylic acid having an M—O bond, etc. is dissolved in an organic solvent to prepare a precursor solution, and the obtained solution is coated and fired on a substrate. The precursor solution herein used is understood to mean a solution containing an intermediate compound produced in the film formation process such as the sol-gel or MOD process wherein the raw compound is dissolved in a solvent.

Generally, the sol-gel and MOD processes are used in combination, rather than used as perfectly separate processes. For instance, when a PZT film is formed, a solution is adjusted using lead acetate as a Pb source and alkoxides as Ti and Zr sources. In some cases, two such sol-gel and MOD processes are collectively called the sol-gel process. In the present disclosure, either process is referred to as the solution coating-and-firing process because a film is formed by coating and firing the precursor solution on a substrate. It is here noted that the dielectric precursor solution used herein includes a solution wherein dielectric particles of the order of sub-$\mu$m are mixed with the precursor solution and the solution coating-and-firing process used herein includes a process wherein that solution is coated and fired on a substrate.

The solution coating-and-firing process, whether it is the sol-gel process or the MOD process, enables a dielectric material to be synthesized at a temperature much lower than that used for a method making essential use of the sintering of ceramic powders as in the case of forming a dielectric material by a thick-film process, because the dielectric forming element is uniformly mixed on the order of sub-$\mu$m or lower.

Taking a perovskite ferroelectric material such as $BaTiO_3$ or PZT as an example, a high temperature of 900 to 1,000° C. or higher is needed for ordinary ceramic powder sintering processes; however, if the solution coating-and-firing process is used, it is then possible to form a film at a low temperature of about 500 to 700° C.

Thus, the formation of the dielectric layer by the solution coating-and-firing process makes it possible to use high heat-resistant glass, crystallized glass, green sheet glass or the like which could not have been used with conventional thick-film processes in view of heat resistance.

In the thin-film EL device of the invention, the dielectric layer is provided in a multilayer form by repeating the solution coating-and-firing step plural times. The step of forming the dielectric layer of the invention is now explained with reference to FIGS. 4A and 4B.

Figure 4A:
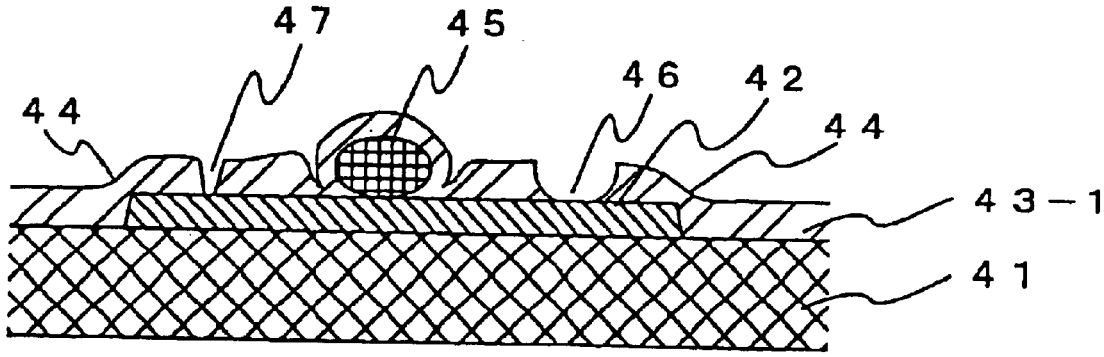
FIGS. 4A and 4B are sectional views illustrative of the steps of forming the insulator layer in the thin-film EL device according to the invention.

Referring first to FIG. 4A, a lower electrode layer 42 patterned in a striped fashion and a first sub-layer 43-1 of a dielectric layer are formed on a substrate 41. When a film is formed by the solution coating-and-firing step, the portion of the film in the vicinity 44 of the pattern edge of the lower electrode become thin because this process has no step coverage capability. Dust 45 ascribable to the production process is entrapped on the substrate. In the vicinity of this dust, too, the thickness of the dielectric layer is reduced. There is also a pinhole 46 left behind by peeling of such dust before or after firing. Upon firing following the solution coating-and-firing step, a crack 47 often occurs for some unknown reasons. The crack in turn becomes a pinhole which may otherwise lead to a defective insulation point in the dielectric layer. Such a crack is likely to occur on a metal electrode layer in particular. One possible primary reason for this could be that when the dielectric layer is fired, too large stresses are applied on the dielectric layer due to the recrystallization of the metal electrode layer and the formation of minute hillocks. Such defects in the dielectric layer cause a decrease in the dielectric strength of the dielectric layer.

Figure 4B:
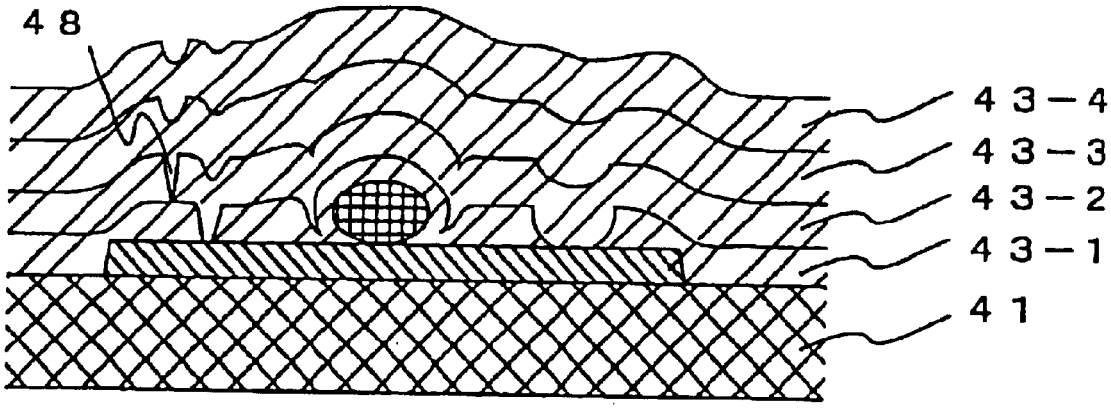

Referring then to FIG. 4B, the dielectric layer is provided in a multilayer form by repeating the solution coating-and-firing step four times. The portion of the first sub-layer in the vicinity of the pattern edge of the lower electrode, the portion of the first sub-layer in the vicinity of dust and the pinhole and crack in the sub-layer, which occur upon the formation of the first sub-layer of the dielectric layer, are all filled up with a second sub-layer 43-2 of the dielectric layer, so that the surface defects of the dielectric layer are reduced or eliminated and, hence, the dielectric strength of the dielectric layer is considerably improved. During the formation of the second sub-layer of the dielectric layer, there is also a possibility that a pinhole or other defect may occur due to the deposition of dust. Since there is little likelihood that a defect 48 in the second sub-layer occurs at the same position as the defect in the first sub-layer, however, the thickness-decreased portions of the first and second sub-layers of the dielectric layer resulting from such defects are allowed to have at least the thickness corresponding to each sub-layer in the dielectric layer.

Especially when the cause of the crack occurring in the second sub-layer 43-2 of the dielectric layer is stress transmitted from the lower metal electrode layer to the dielectric layer, the first sub-layer of the dielectric layer works as a clamp layer for the lower metal electrode layer to relax stresses transmitted to the second or subsequent sub-layers. For this reason, the probability of occurrence of cracks in the second or subsequent sub-layers is so strikingly reduced that a decrease in the dielectric strength of the dielectric layer due to the accumulation of such defects can be avoided.

Referring further to FIG. 4B, a third 44-3 and a fourth sub-layer 44-4 of the dielectric layer are formed. By repeating the solution coating-and-firing step in this way, it is possible to perfectly suppress dielectric strength defects associated with the decrease in the thickness of the dielectric layer due to the vicinity of the pattern edge of the lower metal electrode or defects in the dielectric layer.

It is here appreciated that the respective sub-layers of the multilayer dielectric layer may be formed with equal or different thicknesses, and may be made up of identical or different materials.

Figure 5:
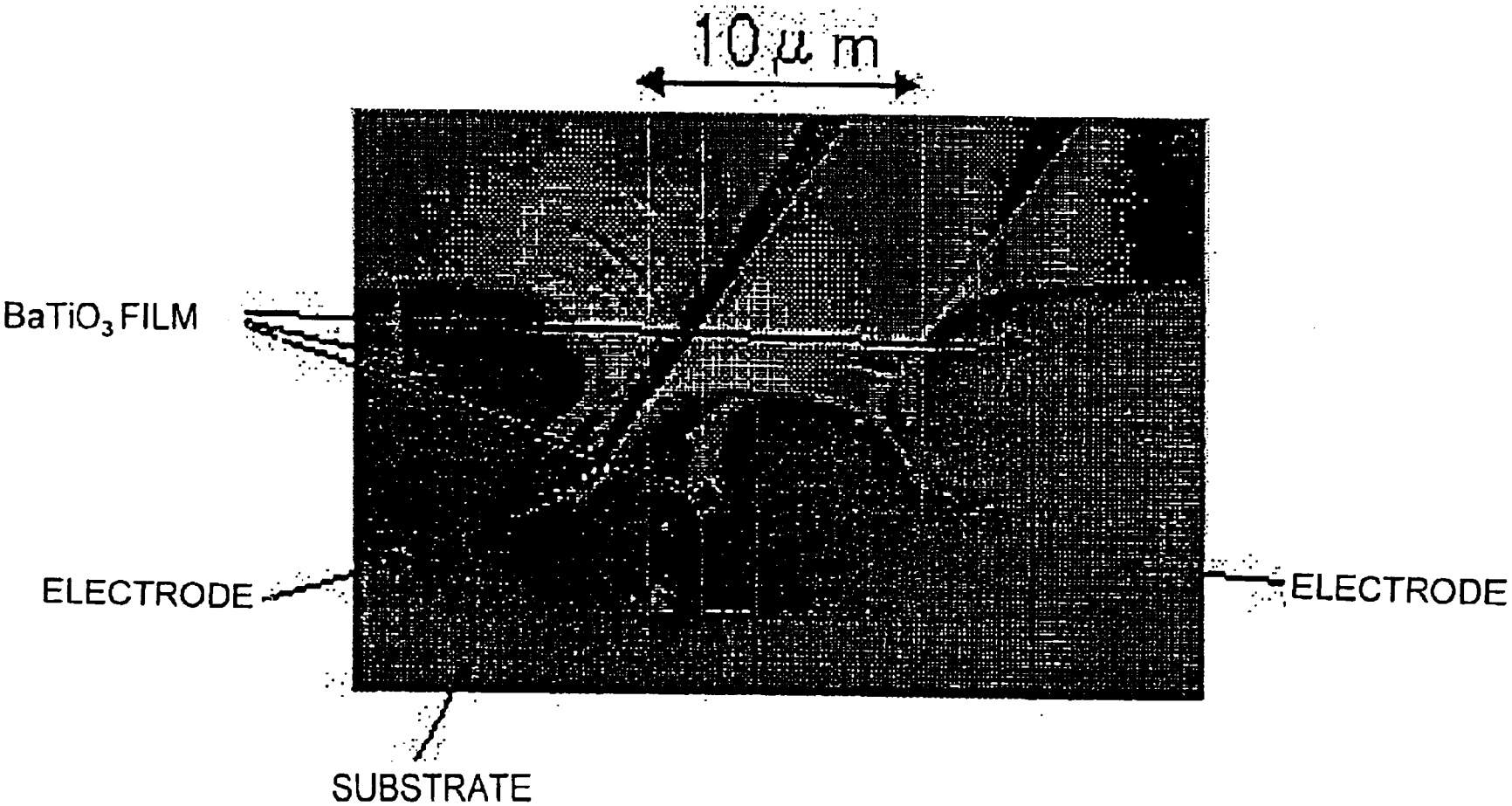
FIG. 5 is an electron microscope photograph illustrative in section of a conventional thin-film EL device.

For a better understanding of the advantages of the invention, a dielectric layer formed by a sputtering process rather than by the solution coating-and-firing step according the invention is now explained with reference to an electron microscope photograph. FIG. 5 is an electron microscope photograph of an 8 μm thick $BaTiO_3$ thin film formed by sputtering on a patterned substrate with a 3 μm thick lower electrode layer provided thereon. As can be seen from FIG. 5, when the dielectric layer is provided by sputtering, the surface of the dielectric film is formed with steps enhanced on a substrate and, hence, there are noticeable asperities and overhangs on the surface thereof. A similar asperity phenomenon on the surface of the dielectric layer is also found when the dielectric layer is formed by an evaporation process, not by the sputtering process. A functional thin film like an EL light-emitting layer cannot possibly be formed and used on such a dielectric layer. Defects inevitably associated with a dielectric layer formed by a conventional process such as a sputtering process and caused by steps on the lower electrode layer, dust or the like can be perfectly covered up by repeating the solution coating-and-firing step of the invention, whereby a dielectric layer having a flattened surface can be obtained.

The results of close experimentation by the inventors show that the aforesaid advantages are particularly outstanding under the following conditions.

The first condition is to form the dielectric layer by repeating the solution coating-and-firing step at least plural times. The resultant advantage has already been explained above. Especially by repeating the step at least three times, it is possible to bring the thickness of each sub-layer at a defective site due to dust, cracks or the like to at least ⅔ of the average thickness of the multilayer dielectric layer. Usually, a margin of about 50% of the predetermined applied voltage is allowed for the design value for the dielectric strength of a dielectric layer. Thus, a dielectric breakdown or other problem can be sharked even at a locally decreased dielectric strength site resulting from the aforesaid defects.

The second condition is to make the thickness of the dielectric layer at least four times as large as the thickness of the lower electrode layer. From the inventors' experimental studies, it has been found that when the thickness of the lower electrode layer is smaller than ¼ of the average thickness of the dielectric layer, it is possible to bring the thickness-decreased portion of the dielectric layer formed on the pattern edge site of the lower electrode to at least about ⅔ of the average thickness of the dielectric layer. It has also been found that the steps on the dielectric layer are smoothed down to a satisfactory level. Such a smoothing effect makes it possible to form a thin-film light-emitting layer uniformly on the dielectric layer.

The third condition is to limit the thickness of the multilayer dielectric layer to 4 μm to 16 μm inclusive. The inventors' studies have revealed that the particle size of dust, etc. occurring at steps in an ordinary clean room, for the most part, is 0.1 to 2 μm, especially about 1 μm, and that by bringing the average thickness of the multilayer dielectric layer to at least 4 μm and especially at least 6 μm, it is possible to bring the dielectric strength of a defective portion of the dielectric layer due to dust or other defects to at least ⅔ of the average dielectric strength.

A thickness exceeding 16 μm results in cost increases because the number of repetition of the solution coating-and-firing step becomes too large. In addition, as the thickness of the dielectric layer increases, it is required to increase the specific dielectric constant per se of the dielectric layer, as can be understood from expressions (3) to (5). At a thickness of 16 μm or greater as an example, the required dielectric constant is 160~640~1,440 or greater. However, much technical difficulty is generally encountered in forming a dielectric layer having a dielectric constant of 1,500 or greater, using the solution coating-and-firing step. In the invention, on the other hand, it is easy to form a defect-free dielectric layer of high dielectric strength, and so it is unnecessary to form a dielectric layer having a thickness exceeding 16 μm. For these reasons, the upper limit to the thickness is 16 μm or less, and preferably 12 μm or less.

The fourth condition is to bring the thickness of each sub-layer in the aforesaid dielectric layer to at least ½ of the thickness of the aforesaid lower electrode. According to the inventors' studies, it has been found that when the thickness of each sub-layer in the dielectric layer is ½ or less of the thickness of the electrode layer, a crack is likely to occur in the portion of the dielectric layer in the vicinity of the pattern edge and remains hardly repaired even after the formation of the next dielectric sub-layer. It has also been found that a new crack is likely to occur in the next dielectric sub-layer.

Further, it has been found that even in the absence of any crack, the ability of the dielectric layer to cover the pattern edge portion of the lower electrode becomes considerably worse when the thickness of each sub-layer in the dielectric layer does not exceed ½ of the electrode layer. The same holds true for the case where the number of the sub-layers stacked is regulated in such a way that the same thickness is finally achieved irrespective of whether the thickness of each sub-layer is less or greater than ½ of the thickness of the electrode layer.

A probable explanation for this phenomenon could be that when the thickness of each sub-layer in the dielectric layer is small, the dielectric layer at the pattern edge portion becomes extremely thin with the result that thermal stress during the firing of the dielectric layer causes stress to be produced in the lower electrode layer.

For the light-emitting layer material, known materials such as the aforesaid ZnS doped with Mn may be used although the invention is not particularly limited thereto. Among these, SrS:Ce is particularly preferred because improved properties are achievable. No particular limitation is imposed on the thickness of the light-emitting layer; however, too large a thickness gives rise to a driving voltage rise whereas too small a thickness brings about a light emission luminance drop. By way of example but not by way of limitation, the light-emitting layer should preferably have a thickness of the order of 100 to 2,000 nm although varying with the light-emitting material used.

The light-emitting layer may be formed by vapor phase deposition processes, among which physical vapor phase deposition processes such as sputtering and evaporation and chemical vapor phase deposition processes such as CVD are preferred. Especially when a light-emitting layer is formed of the aforesaid SrS:Ce, it is possible to obtain a light-emitting layer of high purity by making use of an electron beam evaporation process in a $H_2S$ atmosphere.

After the light-emitting is formed, it should preferably be treated by heating. This heat treatment may be carried out after the electrode, dielectric layer and light-emitting layer are stacked on the substrate in this order or, alternatively, carried out (by cap annealing) after the electrode layer, dielectric layer, light-emitting layer and insulator layer are stacked, optionally with an electrode layer, on the substrate in this order. Although depending on the light-emitting layer, the heat treatment should be carried out at a temperature of preferably 300° C. or higher, and more preferably 400° C. or higher to the firing temperature of the dielectric layer for 10 to 600 minutes. For the heat treatment atmosphere, a suitable selection may be made from air, $N_2$, Ar, He or the like depending on the composition of the light-emitting layer and the conditions for forming it.

The light-emitting layer should preferably have an insulator layer formed thereon, although the insulator layer may be dispensed with as mentioned above. The insulator layer should have a resistivity of at least $10^8$ Ωcm, and preferably about $10^{10}$ to $10^{18}$ Ωcm, and be preferably made up of a material having a relatively high dielectric constant of $\epsilon$=ca. 3 to 1,000. The insulator layer, for instance, may be made up of silicon oxide ($SiO_2$), silicon nitride (SiN), tantalum oxide ($Ta_2O_5$), strontium titanate ($SrTiO_3$), yttriumoxide ($Y_2O_3$), bariumtitanate ($BaTiO_3$), lead titanate ($PbTiO_3$), zirconia ($ZrO_2$), silicon oxynitride (SiON), alumina ($Al_2O_3$) and lead niobate ($PbNb_2O_6$).

The insulator layer may be formed as is the case with the aforesaid light-emitting layer. It is then preferred that the insulator layer have a thickness of 50 to 1,000 nm, and especially about 50 to 500 nm.

The transparent electrode layer may be made up of oxide conductive materials such as ITO, $SnO_2$ (Nesa film) and ZnO—Al of 0.2 μm to 1 μm in thickness, and formed by known techniques such as sputtering as well as evaporation techniques.

While the aforesaid thin-film EL device has been described as having a single light-emitting layer, it is appreciated that the thin-film EL device of the invention is not limited to such construction. For instance, a plurality of light-emitting layers may be stacked in the thickness direction or, alternatively, a matrix combination of different types of light-emitting layers (pixels) may be arranged on a plane.

The thin-film EL device of the invention may be easily identified by observation under an electron microscope. That is, it is seen that the dielectric layer formed by the repetition of the solution coating-and-firing step of the invention is not only in a multilayer form unlike a dielectric layer formed by other processes but is also different in quality therefrom. In addition, this dielectric layer has another feature of very excellent surface smoothness.

As already explained, the thin-film EL device of the invention allows high-performance, high-definition displays to be easily set up because the dielectric layer, on which the light-emitting layer is to be stacked, is of very excellent surface smoothness and high dielectric strength, and is free from any defect as well. Furthermore, the thin-film EL device of the invention is so easy to fabricate that fabrication costs can be cut down.

EXAMPLE

The present invention is now explained more specifically with reference to examples.

Example 1

A 1 μm thick Au thin film with trace additives added thereto was formed by sputtering on a surface polished alumina substrate of 99.6% purity, and heat treated at 700° C. for stabilization. Using a photoetching process, this Au thin film was patterned in a striped arrangement comprising a number of stripes having a width of 300 μm and a space of 30 μm.

A dielectric layer was formed on the substrate using the solution coating-and-firing step. The dielectric layer was formed by repeating given times the solution coating-and-firing step wherein a sol-gel solution prepared as mentioned below was spin coated as a PZT precursor solution on the substrate and fired at 700° C. for 15 minutes.

To prepare a basic sol-gel solution, 8.49 grams of lead acetate trihydrate and 4.17 grams of 1,3-propanediol were heated under agitation for about 2 hours to obtain a transparent solution. Apart from this, 3.70 grams of a 70 wt % 1-propanol solution of zirconium.normal propoxide and 1.58 grams of acetylacetone were heated under agitation in a dry nitrogen atmosphere for 30 minutes to obtain a solution, which was then heated under agitation for a further 2 hours, with the addition thereto of 3.14 grams of a 75 wt % 2-propanol solution of titanium.diisopropoxide.bisacetyl acetonate and 2.32 grams of 1,3-propanediol. Two such solutions were mixed together at 80° C., and the resultant mixture was heated under agitation for 2 hours in a dry nitrogen atmosphere to prepare a brown transparent solution. This solution, after held at 130° C. for a few minutes to remove by-products therefrom, was heated under agitation for a further three hours, thereby preparing a PZT precursor solution.

The viscosity of the sol-gel solution was regulated by dilution with n-propanol. By control of the spin coating conditions and the viscosity of the sol-gel solution, the thickness of each sub-layer in the dielectric layer was regulated to 0.4 μm or 0.7 μm. Dielectric layers shown in Table 1 were formed by the repetition of the spin coating-and-firing step of the aforesaid sol-gel solution as the PZT precursor solution.

TABLE 1

Figure 6:
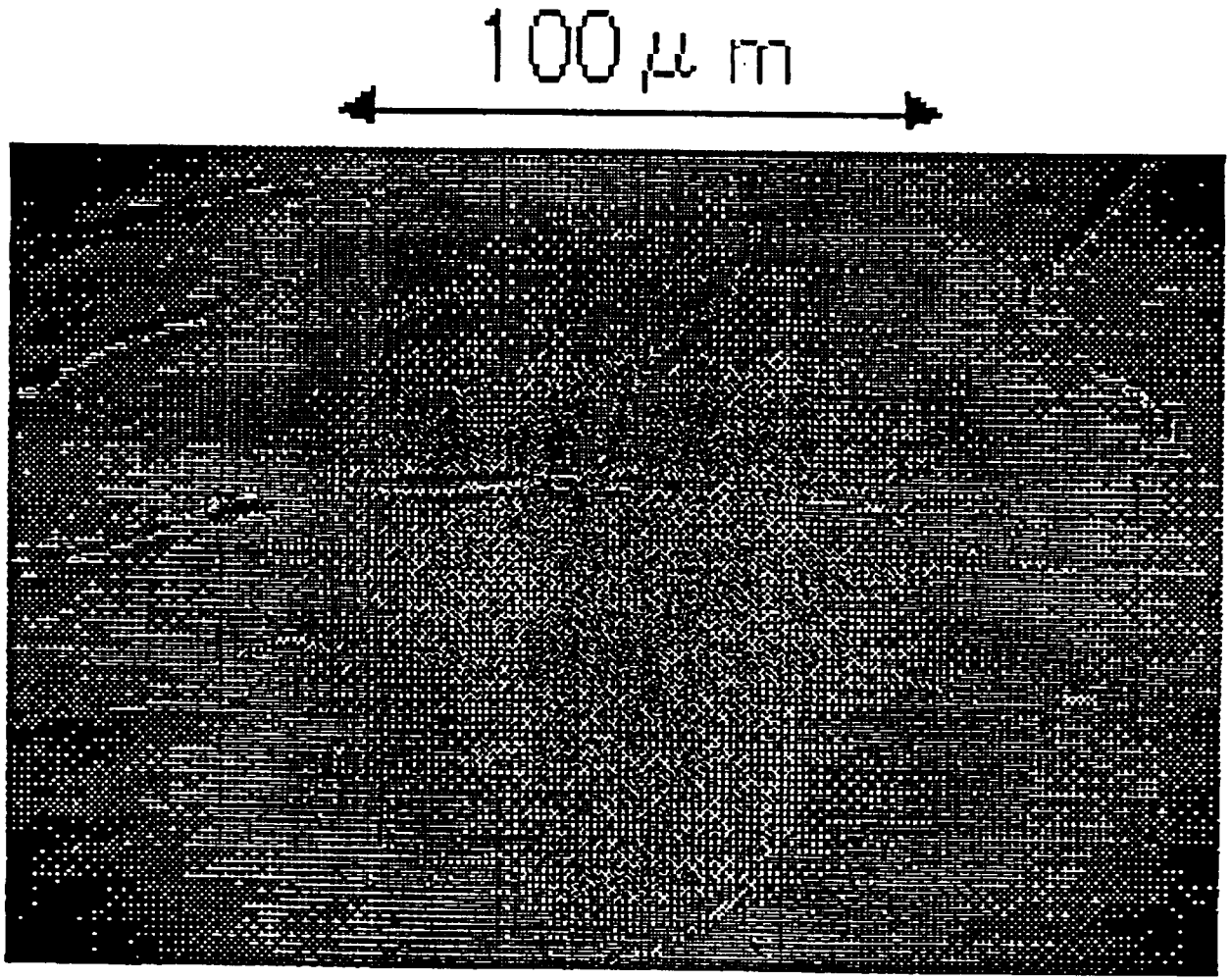
FIG. 6 is an electron microscope photograph of the surface of the insulator layer in the thin-film EL device according to a comparative example.
Figure 7:
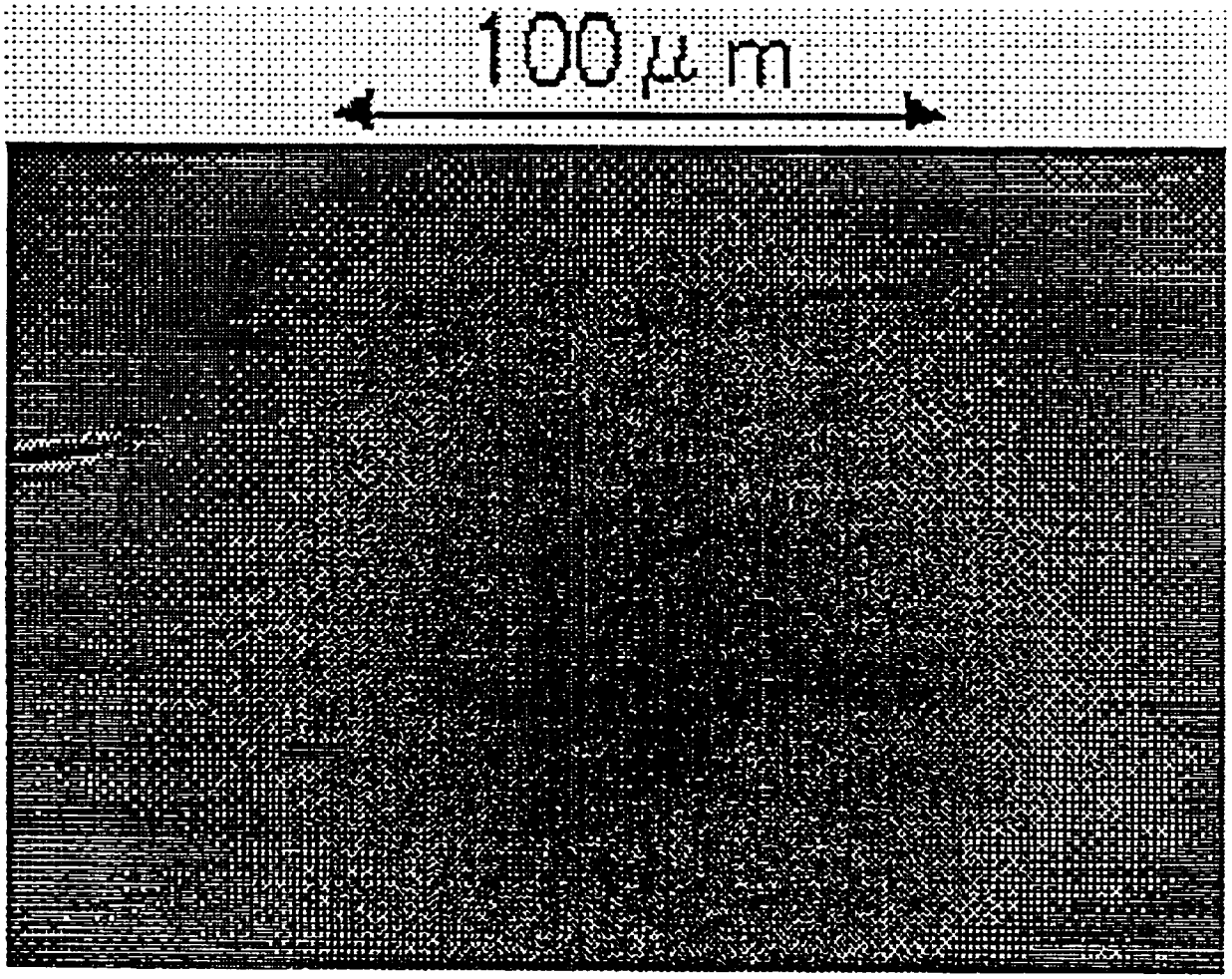
FIG. 7 is an electron microscope photograph of the surface of the insulator layer in one thin-film EL device according to the invention.
Figure 8:
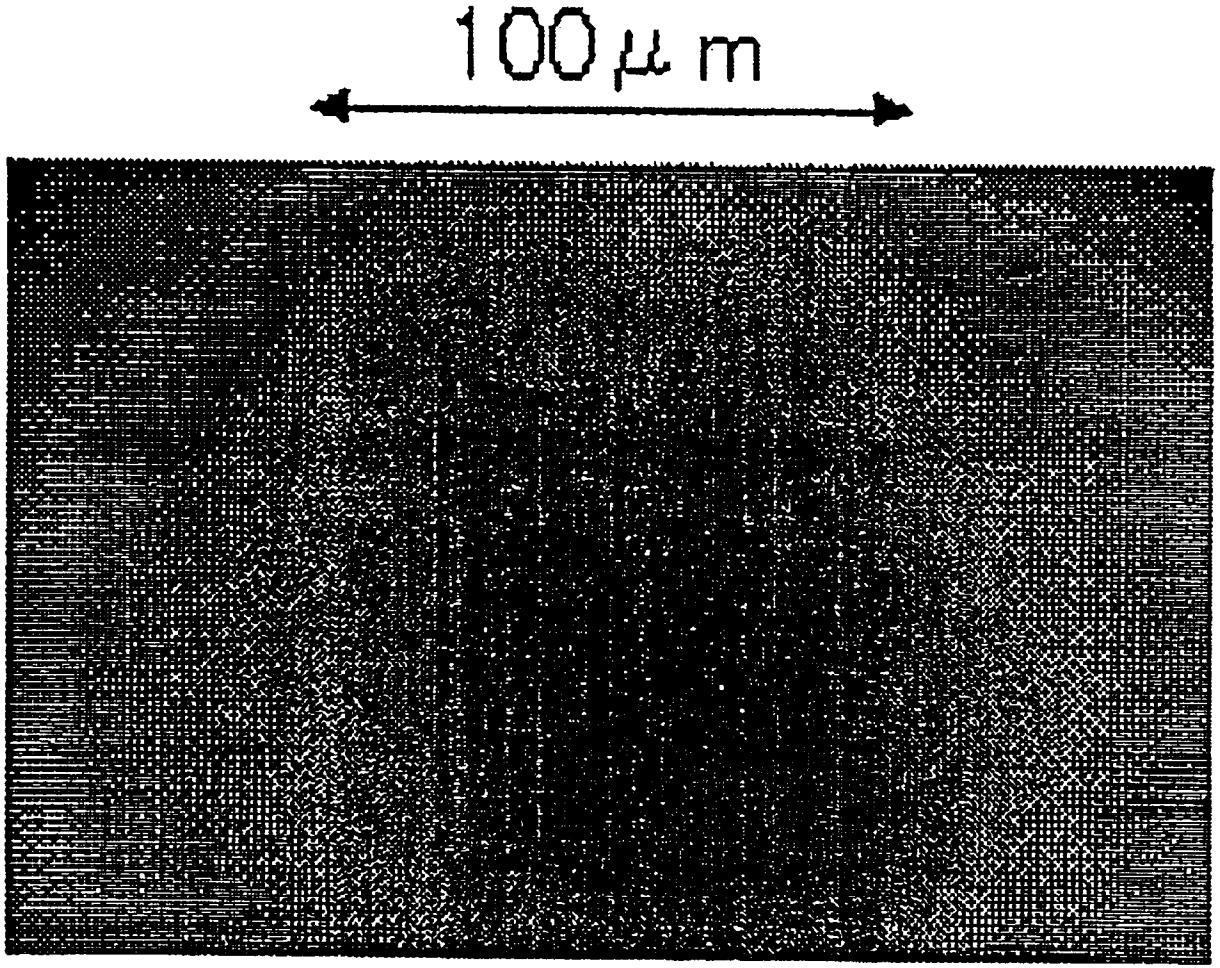
FIG. 8 is an electron microscope photograph of the surface of the insulator layer in another thin-film EL device according to the invention.

| Sample | Total thickness (μm) | Film structure | Dielectric strength (V) | Dielectric constant | Electron microscope photograph | Remarks |
|---|---|---|---|---|---|---|
| 11 | 2.0 | 0.4 × 5 | 0 | — | FIG. 6 | Comparative |
| 12 | 2.1 | 0.7 × 3 | 30 | 500 | FIG. 7 | Comparative |
| 13 | 3.5 | 0.7 × 5 | 140 | 520 | — | Comparative |
| 14 | 4.2 | 0.7 × 6 | 220 | 540 | FIG. 8 | Inventive |
| 15 | 4.4 | 0.4 × 11 | 170 | 530 | — | Inventive |
| 16 | 7.0 | 0.7 × 10 | 320 | 600 | — | Inventive |
| 17 | 14.0 | 0.7 × 20 | 430 | 620 | — | Inventive |
| 18 | 16.4 | 0.7 × 22 | 450 | 620 | — | Comparative |

In Table 1, the "film structure" represents "thickness x number of stacking". For instance, the film structure of sample No. 14 is a stack of six sub-layers, each of 0.7 μm in thickness. As can be understood from Table 1, each sample made up of a multilayer dielectric layer of less than 4 μm in thickness has a low dielectric strength and so is unsuitable for use with a thin-film EL device. With the sample made up of a multilayer dielectric layer whose sub-layers were each less than 0.4 μm in thickness or less than ½ of the thickness (1 μm) of the electrode layer, any satisfactory results were not obtained due to considerable dielectric strength drops.

FIGS. 6, 7 and 8 are the electron microscope photographs of the surfaces of dielectric layer sample Nos. 11, 12 and 14, respectively. It can be seen that in dielectric layer sample No. 11 made up of sub-layers, each of 0.4 μm in thickness, and having a total thickness of 2 μm, cracks are not perfectly filled up and remain on the surface of the dielectric layer. In dielectric layer sample No. 12 made up of sub-layers, each of 0.7 μm in thickness, yet having a total thickness of 2.1 μm on much the same level as sample No. 11, however, surface cracks are perfectly filled up although some traces of cracking are found. Further, in dielectric layer sample No. 14 having a total thickness of 4.2 μm, traces of cracking vanish away altogether. When the thickness of each sub-layer in the dielectric layer is less than ½ of the thickness of the electrode layer, there is thus a likelihood that the occurrence of cracks in the dielectric layer due to stresses resulting from the electrode layer cannot be suppressed to a sufficient level and so no dielectric strength is obtained.

It is also found that if the thickness of the multilayer dielectric layer is no less than four times as large as the thickness of the lower electrode, satisfactory dielectric strength can then be achieved.

Each of dielectric layers formed as in the case of sample Nos. 13 to 18 in Table 1 was formed thereon with a 0.8 μm thick ZnS light-emitting thin film while heated at 200° C. by means of an evaporation process using a ZnS evaporation source doped with Mn, and then heat treated at 600° C. for 10 minutes in a vacuum.

Then, the dielectric layer was successively provided thereon with an $Si_3N_4$ thin film as a second insulator layer and an ITO thin film as an upper electrode layer, thereby obtaining a thin-film EL device. In this case, the upper electrode layer of ITO thin film was formed according to a pattern comprising stripes of 1 mm in width, using a metal mask. The light emission properties of the obtained device structure were measured with the application of an electric field at which the light emission luminance was saturated at a pulse width of 50 μs at 1 kHz while electrodes were led out of the lower electrode and upper transparent electrode. For evaluation, a given number of samples per thin-film EL device were prepared.

As a result, the thin-film EL device using sample No. 13 was broken due to a dielectric breakdown on the application of a voltage in the vicinity of the light emission threshold (140 to 160 V). Approximately half of the samples prepared for sample No. 15 suffered from a dielectric breakdown before the maximum luminance was reached, probably thanks to their low dielectric strengths. In contrast, all the thin-film EL devices formed on sample Nos. 14, 16, 17 and 18 showed a maximum luminance of 6,000 to 10,000 cd/m$^2$, and suffered from no dielectric breakdown even at the then applied voltage.

Example 2

A soda lime-based high heat-resistant glass substrate (having a softening point of 820° C.) was provided. A 0.5 μm thick Ag/Pd/Cu thin film as a thin-film lower electrode layer was formed by sputtering on this substrate, and then heat treated at 700° C. for stabilization. A pattern comprising a number of stripes of 500 μm in width and 50 μm in space was formed by patterning the thin-film lower electrode layer using a photoetching process.

A dielectric layer was formed on the substrate using the solution coating-and-firing step. The dielectric layer was formed by repeating given times the solution coating-and-firing step wherein a sol-gel solution prepared as mentioned below was dip coated as a $BaTiO_3$ precursor solution on the substrate and fired at the maximum temperature of 700° C. for 10 minutes. The then thickness of each sub-layer in the dielectric layer was 1.5 μm.

To prepare the $BaTiO_3$ precursor solution, PVP (polyvinyl pyrrolidone) having a molecular weight of 630,000 was completely dissolved in 2-propanol, and acetic acid and titanium tetraisopropoxide were added to the resulting solution under agitation, thereby obtaining a transparent solution. A mixed solution of pure water and barium acetate was added dropwise to this transparent solution under agitation. While stirring was continued in this state, the resultant solution was aged for a given time. The composition ratio for the respective starting materials was barium acetate:titanium tetraisopropoxide:PVP:acetic acid:pure water:2-propanol= 1:1:0.5:9:20:20. In this way, the $BaTiO_3$ precursor solution was obtained.

The dielectric layers shown in Table 2 were formed by repeating the coating and firing of the aforesaid $BaTiO_3$ precursor solution.

TABLE 2

| Sample | Total thickness (μm) | Film structure | Dielectric strength (V) | Dielectric constant | Remarks |
|---|---|---|---|---|---|
| 21 | 1.5 | 1.5 × 1 | 0 | — | Comparative |
| 22 | 3.0 | 1.5 × 2 | 80 | 350 | Comparative |
| 23 | 4.5 | 1.5 × 3 | 250 | 370 | Inventive |
| 24 | 7.5 | 1.5 × 5 | 350 | 380 | Inventive |
| 25 | 12.0 | 1.5 × 8 | 390 | 380 | Inventive |
| 26 | 15.0 | 1.5 × 10 | 450 | 390 | Inventive |
| 27 | 19.5 | 1.5 × 13 | 460 | 400 | Comparative |

In Table 2, the "film structure" represents "thickness× number of stacking" as in Table 1. In this case, too, no dielectric strength is obtained when the thickness of the multilayer dielectric layer is less than four times as large as the thickness of the electrode. A multilayer dielectric layer having a thickness less than 4 μm has a low dielectric strength, and so is unsuitable for use with an EL substrate.

Each of the thus formed sample Nos. 22 to 27 was provided thereon with a light-emitting layer, an insulator layer and an upper transparent electrode as in Example 1 for the purpose of evaluating light emission properties.

As a result, the thin-film EL device using sample No. 22 was broken due to a dielectric breakdown on the application of a voltage in the vicinity of the light emission threshold (140 to 160 V). All the thin-film EL devices formed on substrates 23 to 26 had showed a maximum luminance of 6,000 to 10,000 cd/m$^2$ and suffered from no dielectric breakdown. In the case of the thin-film EL device formed on substrate 27, on the other hand, no maximum luminance was obtained even upon the application of 350 V that was the maximum applied voltage of the power source used for evaluation.

Advantages of the Invention

From the foregoing, the advantages of the invention can be understood.

The present invention a solution to all problems with the prior art viz., an fatal defect to display devices, which, when an insulator layer is made up of a thin film, results from destruction of a light-emitting layer due to a local dielectric strength decrease ascribable to defects in the insulator layer; poor light emission properties which, when a thick-film dielectric layer made up of ceramics is used, result from defects on the surface of the dielectric layer, the fact that the dielectric layer is porous, and the asperity configuration of the surface of the dielectric layer; cost increases due to the addition of a difficult-to-perform step, i.e., the step of polishing the surface of the thick-film dielectric layer, and further cost increases due to the addition of a sol-gel step; and limitations imposed on the selection of substrate and electrode layer materials thanks to the firing temperature for the thick-film dielectric layer. Thus, the present invention provides a thin-film EL device and its fabrication process without incurring any cost increase. The thin-film EL device of the invention allows restrictions on the selection of substrate materials to be removed, and so makes it possible to use glass substrates which are inexpensive and can be easily processed to a large area, and can rely on a quick-and-easy process to make correction for non-flat portions of a dielectric layer due to an electrode layer, and dust, etc. resulting from process steps, thereby preventing any dielectric strength decrease. In addition, the thin-film EL device of the invention ensures high display quality by virtue of the satisfactory flatness of the surface of the dielectric layer.

What we claim is:

1. A thin-film EL device having at least a structure comprising an electrically insulating substrate, a patterned electrode layer stacked on said substrate, and a dielectric layer, a light-emitting layer and a transparent electrode stacked on said electrode layer, wherein:

said dielectric layer is a multilayer dielectric layer formed in a multilayer form by repeating a solution coating-and-firing step plural times, and said multilayer dielectric layer has a thickness of at least four times as large as a thickness of said electrode layer and 4 $\mu$m to 16 $\mu$m inclusive.

2. The thin-film EL device according to claim 1, wherein said multilayer dielectric layer is formed by repeating said solution coating-and-firing step at least three times.

3. The thin-film EL device according to claim 1, wherein said multilayer dielectric layer has a thickness per sub-layer of at least ½ of said electrode layer.

4. The thin-film EL device according to claim 1, wherein said electrically insulating substrate maintains a given heat-resistant strength without contaminating said patterned electrode layer and said dielectric layer.

5. The thin-film EL device according to claim 1, wherein said electrically insulating substrate is selected from the group consisting of alumina ($Al_2O_3$), quartz glass ($SiO_2$), magnesia (MgO), forsterite ($2MgO.SiO_2$), steatite ($MgO.SiO_2$), mullite ($3Al_2O_3.2SiO_2$), beryllia (BeO), zirconia ($ZrO_2$), aluminum nitride (AlN), silicon nitride (SiN), silicon carbide (SiC), crystallized glass, high heat-resistance glass, green sheet glass substrates and enameled metal substrates.

6. The thin-film EL device according to claim 1, wherein said patterned electrode layer has a pattern comprising a plurality of stripes.

7. The thin-film EL device according to claim 6, wherein a line width of said stripes of said patterned electrode is 200 to 500 $\mu$m and a space between two stripes is about 20 $\mu$m.

8. The thin-film EL device according to claim 1, wherein said patterned electrode layer comprises an oxide conductive material, a base metal, a noble metal, a noble metal alloy and a combination of a noble metal with a nonmetal element.

9. The thin-film EL device according to claim 1, wherein a specific dielectric constant of said dielectric layer is at least 10 times as large as the thickness of the dielectric layer as expressed in $\mu$m.

10. The thin-film EL device according to claim 1, wherein said dielectric layer comprises a material selected from the group consisting of dielectric materials having perovskite structures, composite perovskite-relaxor ferroelectric materials, bismuth layer-structured compounds and tungsten bronze ferroelectric materials.

11. The thin-film EL device according to claim 1, wherein said coating-and-firing processe comprises a sol-gel process, an MOD process or a combination thereof.

12. The thin-film EL device according to claim 1, wherein said light-emitting layer comprises ZnS doped with Mn.

13. The thin-film EL device according to claim 1, wherein said light-emitting layer comprises SrS:Ce.

14. The thin-film EL device according to claim 1, wherein said light-emitting layer has a thickness of 100 to 2,000 nm.

15. The thin-film EL device according to claim 1, further comprising an insulator layer disposed on said light-emitting layer.

16. The thin-film EL device according to claim 15, wherein said insulator layer has a thickness of 50 to 1,000 nm.

17. The thin-film EL device according to claim 1, wherein said transparent electrode layer comprises an oxide conductive material.

* * * * *